US008708653B2

(12) United States Patent
Lin et al.

(10) Patent No.: US 8,708,653 B2
(45) Date of Patent: Apr. 29, 2014

(54) FAN STRUCTURE HAVING A FIRST IMPELLER AND A SECOND IMPELLER

(75) Inventors: Mao-Sheng Lin, Pingtung (TW); Cheng-Chun Chou, Pingtung (TW)

(73) Assignee: ADDA Corp., Pingtung, Pintung County (TW)

( * ) Notice: Subject to any disclaimer, the term of this patent is extended or adjusted under 35 U.S.C. 154(b) by 908 days.

(21) Appl. No.: 12/875,243

(22) Filed: Sep. 3, 2010

(65) Prior Publication Data

US 2012/0057977 A1 Mar. 8, 2012

(51) Int. Cl.
*F04D 29/28* (2006.01)

(52) U.S. Cl.
USPC ..... 416/126; 416/187; 416/198 R

(58) Field of Classification Search
USPC ..... 415/99, 100, 198.1, 199.4; 416/122, 416/124, 126, 175, 183, 186 R, 187, 198 R, 416/200 R
See application file for complete search history.

(56) References Cited

U.S. PATENT DOCUMENTS

| | | | | |
|---|---|---|---|---|
| 6,508,628 | B2 * | 1/2003 | Amr | 416/189 |
| 2003/0063975 | A1 * | 4/2003 | Horng et al. | 416/183 |
| 2006/0039783 | A1 * | 2/2006 | Horng et al. | 415/206 |
| 2007/0110574 | A1 * | 5/2007 | Lu et al. | 415/206 |

* cited by examiner

*Primary Examiner* — Edward Look
*Assistant Examiner* — Jesse Prager
(74) *Attorney, Agent, or Firm* — Jackson IPG PLLC

(57) ABSTRACT

A fan structure comprises a first impeller and a second impeller, wherein the first impeller is composed of a first annular substrate, a plurality of first ribs and a plurality of first blades. The first ribs and the first blades are formed on the first annular substrate, each of the first ribs comprises an engaging hole, and a first accommodating space is formed between each of the adjacent first blades. The second impeller is composed of a hub, a second annular substrate, a plurality of second ribs, a plurality of second blades and at least one engaging member formed on the second ribs. The second ribs and the second blades are formed on the second annular substrate, and a second accommodating space is formed between each of the adjacent second blades. The first blades and the second blades are arranged in a staggered relationship.

9 Claims, 7 Drawing Sheets

FAN STRUCTURE HAVING A FIRST IMPELLER AND A SECOND IMPELLER

FIELD OF THE INVENTION

The present invention is generally relating to a fan structure, more particularly to an assembly fan structure.

BACKGROUND OF THE INVENTION

Referring to FIG. 1, a conventional fan structure 10 was manufactured by method of injection molding with a forming mold (not shown in Fig). The fan structure 10 comprises a base 11, a hub 12 disposed on the base 11, a casing 13 and a plurality of fan blades 14 be in communication with the casing 13 and the base 11. In order to provide a high static pressure capability, the number of the fan blades 14 will be increased so that the spacing D between each of the fan blades 14 will be decreased thereby causing processing difficulty. Moreover, the mentioned forming mold must be fabricated by methods of wire-cut or electrical discharge to lead higher cost. Besides, in the manufacturing process of the fan structure 10, shrinking the spacing D may cause low mechanical strength and long fabricating time by using a cutting tool having small diameter instead of a cutting tool having large diameter. Tool life of the cutting tool having small diameter are shorter than one having large diameter through repetitive processing.

SUMMARY

A primary object of the present invention is to provide a fan structure comprising a first impeller and a second impeller, wherein the first impeller is composed of a first annular substrate, a plurality of ribs and a plurality of first blades. The first annular substrate has a first outer lateral surface, a first inner lateral surface corresponded to the first outer lateral surface, a first bottom surface in communication with the first outer lateral surface and the first inner lateral surface and a first top surface corresponded to the first bottom surface. The first ribs and the first blades are formed on the first annular substrate, each of the first ribs comprises an engaging hole, and a first accommodating space is formed between each of the adjacent first blades. The second impeller is composed of a hub, a second annular substrate, a plurality of second ribs, a plurality of second blades and at least one engaging member formed on the second ribs. The second annular substrate has a second outer lateral surface, a second inner lateral surface corresponded to the second outer lateral surface, a second top surface in communication with the second outer lateral surface and the second inner lateral surface and a second bottom surface corresponded to the second top surface. The second ribs and the second blades are formed on the second annular substrate, and a second accommodating space is formed between each of the adjacent second blades. The first impeller is integrated with the second impeller and the first bottom surface of the first annular substrate is faced toward the second top surface of the second annular substrate. The engaging member of the second impeller is inserted into the engaging hole of the first impeller, each of the first blades is located in the second accommodating space separately, and each of the second blades is located in the first accommodating space separately. The first blades and the second blades are arranged in a staggered relationship.

The manufacturing process of this invention fabricates the first impeller and the second impeller separately that makes the first blades of the first impeller and the second blades of the second impeller easy to be made. Via the engaging member being inserted into the engaging hole, the first impeller is fixed with the second impeller, and each of the first blades be located in the second accommodating space separately and each of the second blades be located in the first accommodating space separately so that the number of fan blades may be increased. Besides, separated fabrication for the forming molds of the first impeller and the second impeller may lower processing difficulty, raise mechanical strength and extend tool life. Further, by using cutting tool having large diameter to produce the first impeller and the second impeller, the production cost can be effectively saved.

DETAILED DESCRIPTION OF THE INVENTION

Figure 1:
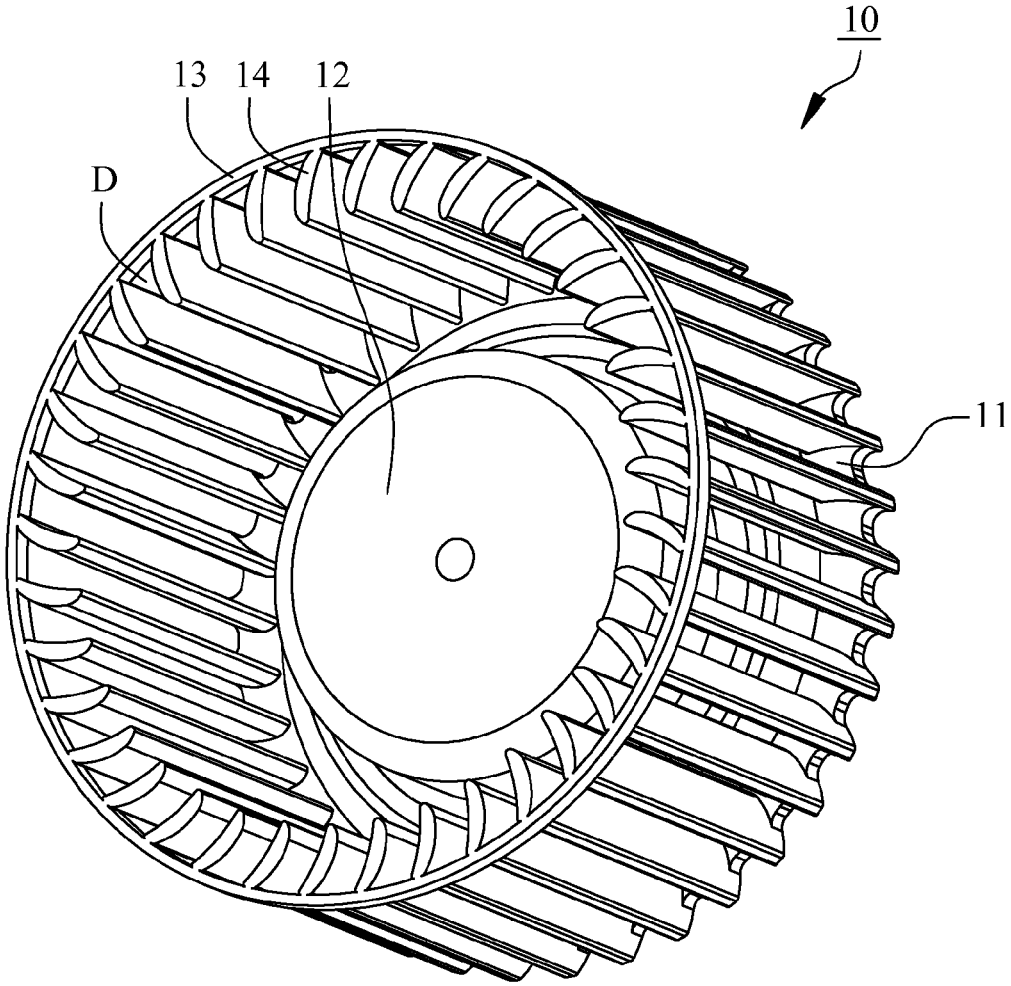
FIG. 1 PRIOR ART
FIG. 1 is a perspective view illustrating a conventional fan structure.
Figure 2:
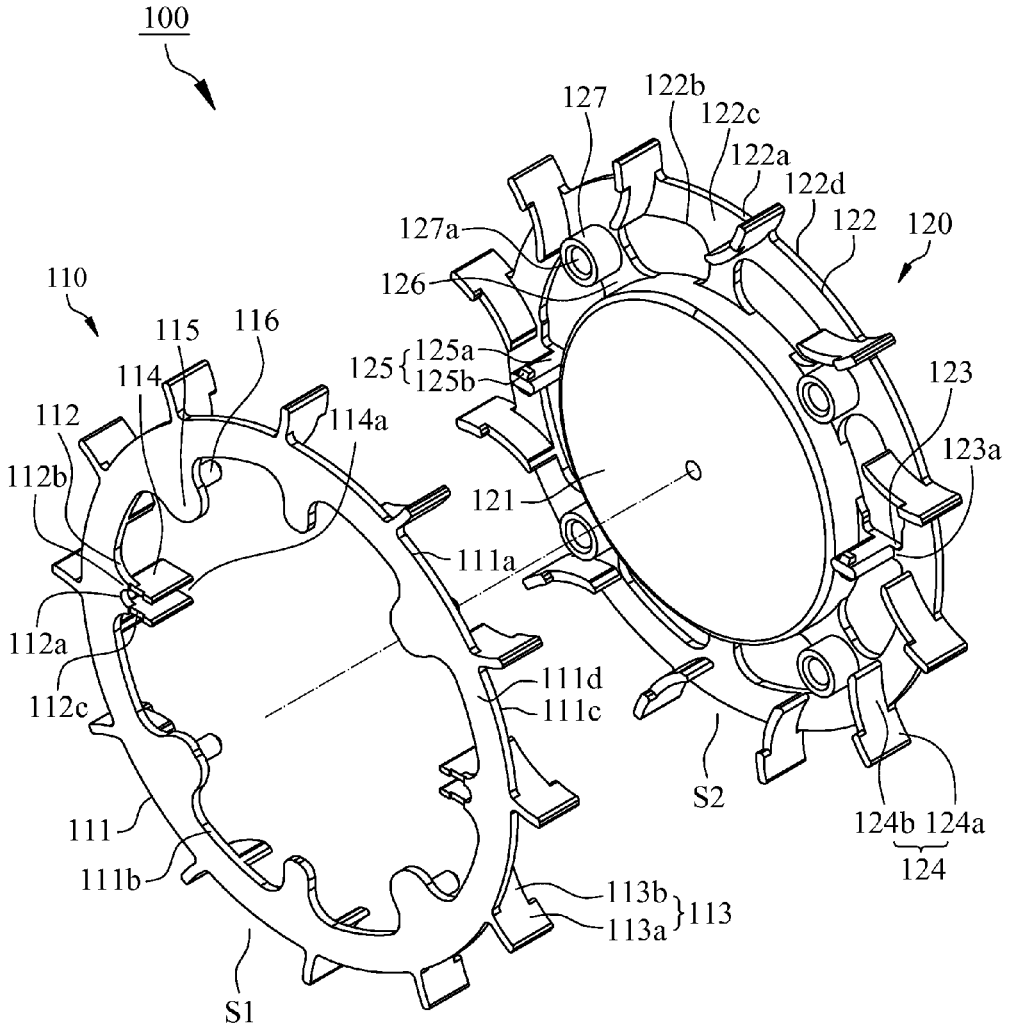
FIG. 2 is a perspective exploded view illustrating a fan structure in accordance with an embodiment of the present invention.
Figure 3:
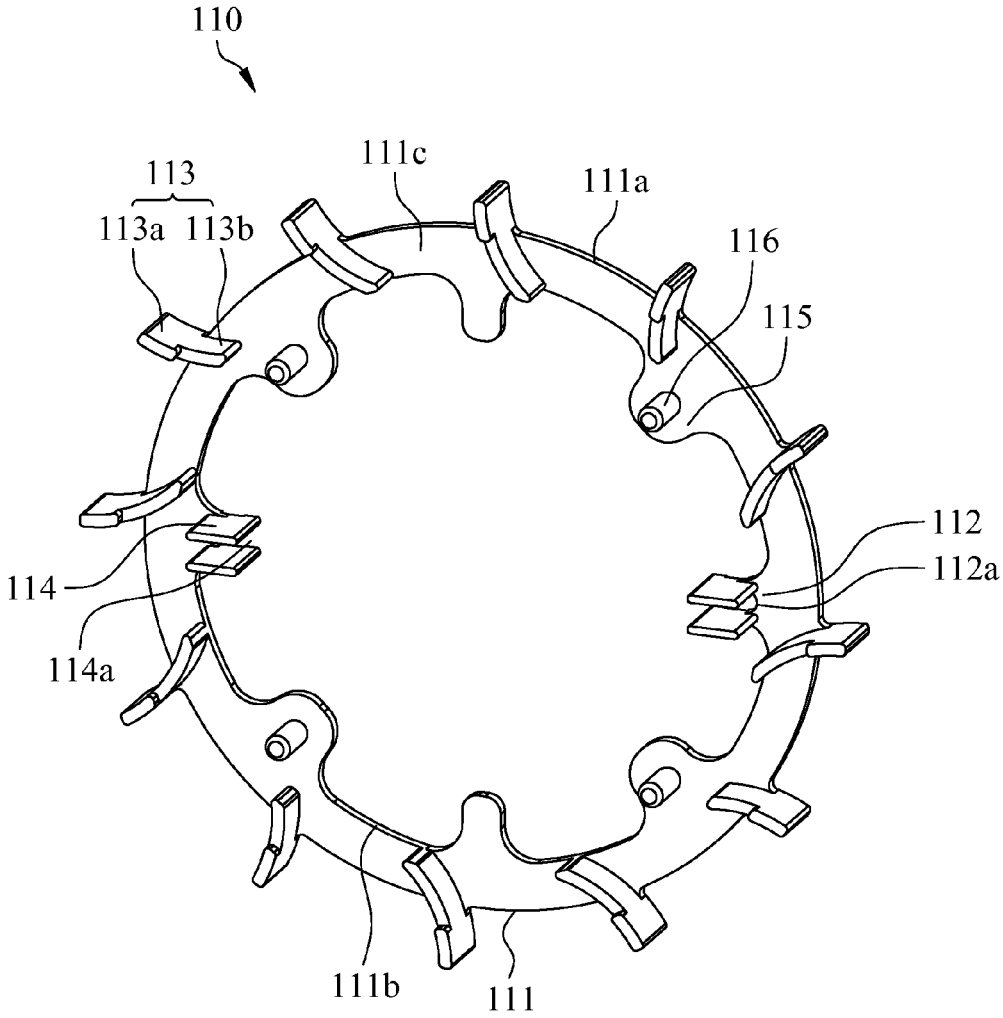
FIG. 3 is a perspective view illustrating a first impeller of the fan structure in accordance with an embodiment of the present invention.
Figure 4:
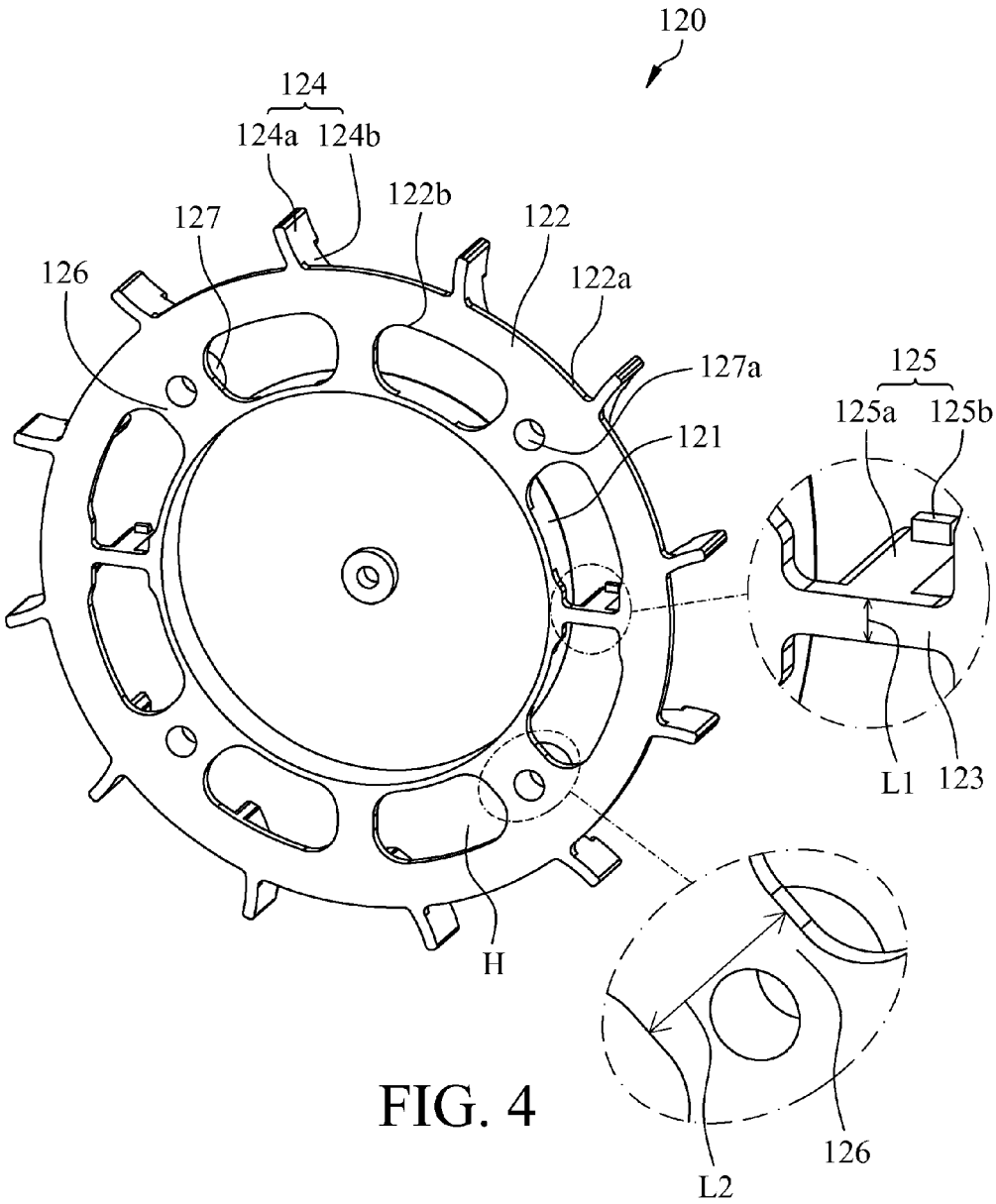
FIG. 4 is a perspective view illustrating a second impeller of the fan structure in accordance with an embodiment of the present invention.

Referring to FIGS. 2, 3 and 4, in accordance with one embodiment of the present invention, a fan structure 100 comprises a first impeller 110 and a second impeller 120, with reference to FIGS. 2 and 3, the first impeller 110 is mainly composed of a first annular substrate 111, a plurality of first ribs 112 and a plurality of first blades 113, wherein the first ribs 112 and the first blades 113 are formed on the first annular substrate 111. In this embodiment, the first annular substrate 111 has a first outer lateral surface 111*a*, a first inner lateral surface 111*b* corresponded to the first outer lateral surface 111*a*, a first bottom surface 111*c* and a first top surface 111*d* corresponded to the first bottom surface 111*c*, wherein the first bottom surface 111*c* is in communication with the first outer lateral surface 111*a* and the first inner lateral surface 111*b*. The first ribs 112 are formed on the first inner lateral surface 111*b* and each of the first ribs 112 comprises an engaging hole 112*a*. The first blades 113 are formed on the first bottom surface 111*c* and a first accommodating space S1 is formed between each of the adjacent first blades 113. In this embodiment, each of the first blades 113 includes a first outer blade 113*a* protruded to the first outer lateral surface 111*a* of the first annular substrate 111 and a first inner blade 113*b* protruded to the first bottom surface 111*c* of the first annular substrate 111.

Referring to FIGS. 2 and 4, the second impeller 120 is mainly composed of a hub 121, a second annular substrate 122, a plurality of second ribs 123, a plurality of second blades 124 and at least one engaging member 125 formed on the second ribs 123, wherein the second annular substrate 122 surrounds the hub 121, and the second ribs 123 are located between the second annular substrate 122 and the hub 121. In this embodiment, one end of each of the second ribs 123 is in communication with the second annular substrate 122 and another end of each of the second ribs 123 is in communication with the hub 121. The second blades 124 are formed on the second annular substrate 122 and a second accommodating space S2 is formed between each of the adjacent second blades 124. The second annular substrate 122 comprises a second outer lateral surface 122*a*, a second inner lateral surface 122*b* corresponded to the second outer lateral surface 122*a*, a second top surface 122*c* and a second bottom surface 122*d* corresponded to the second top surface 122*c*, wherein the second top surface 122*c* is in communication with the second outer lateral surface 122*a* and the second inner lateral surface 122*b*, the second ribs 123 are formed on the second inner lateral surface 122*b* and each of the second ribs 123 comprises an upper surface 123*a*, wherein the engaging member 125 is formed on the upper surface 123*a*, and the second blades 124 are formed on the second top surface 122*c*. In this embodiment, each of the second blades 124 comprises a second outer blade 124*a* protruded to the second outer lateral surface 122*a* of the second annular substrate 122 and a second inner blade 124*b* protruded to the second top surface 122*c* of the second annular substrate 122.

Figure 5:
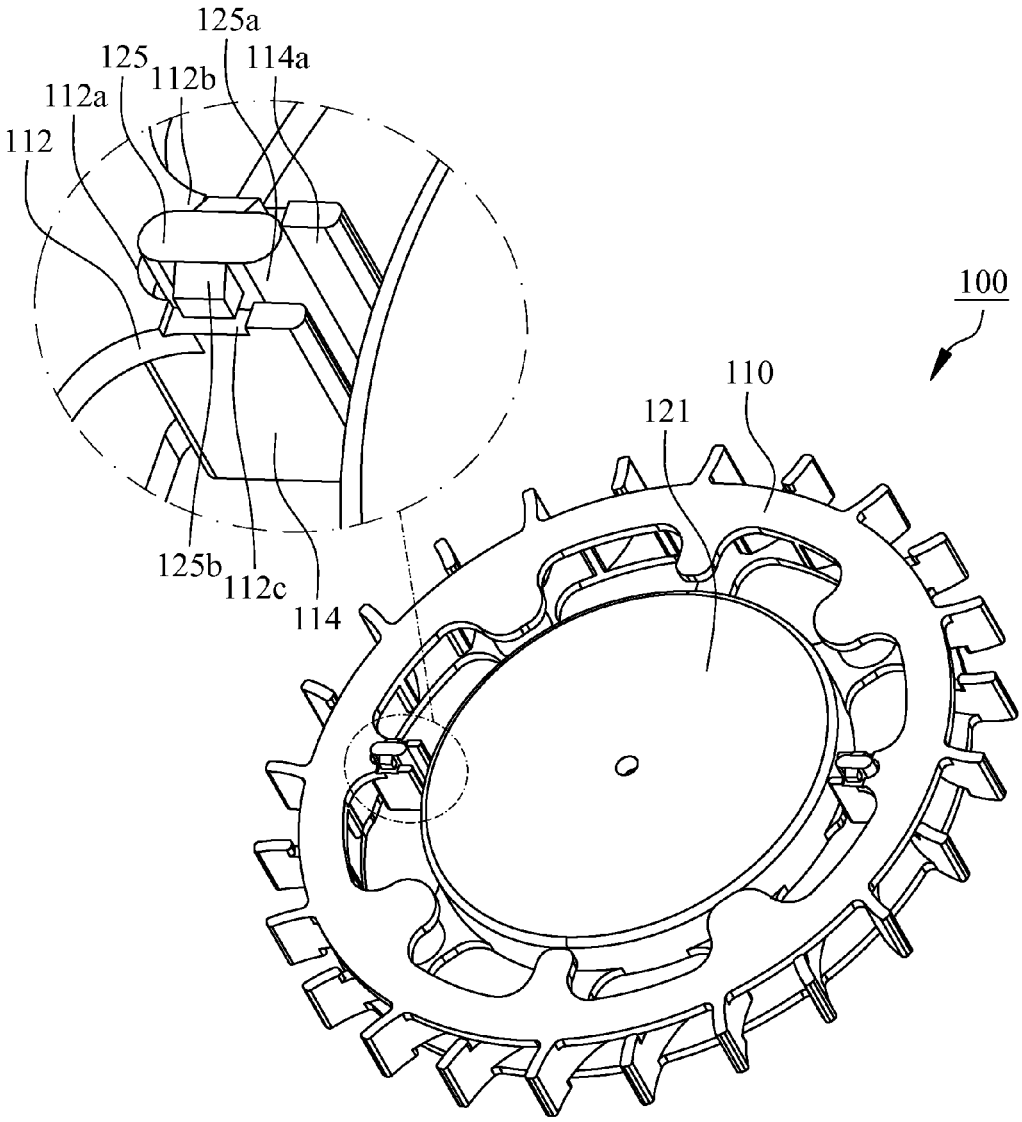
FIG. 5 is a perspective view illustrating the fan structure in accordance with an embodiment of the present invention.
Figure 6:
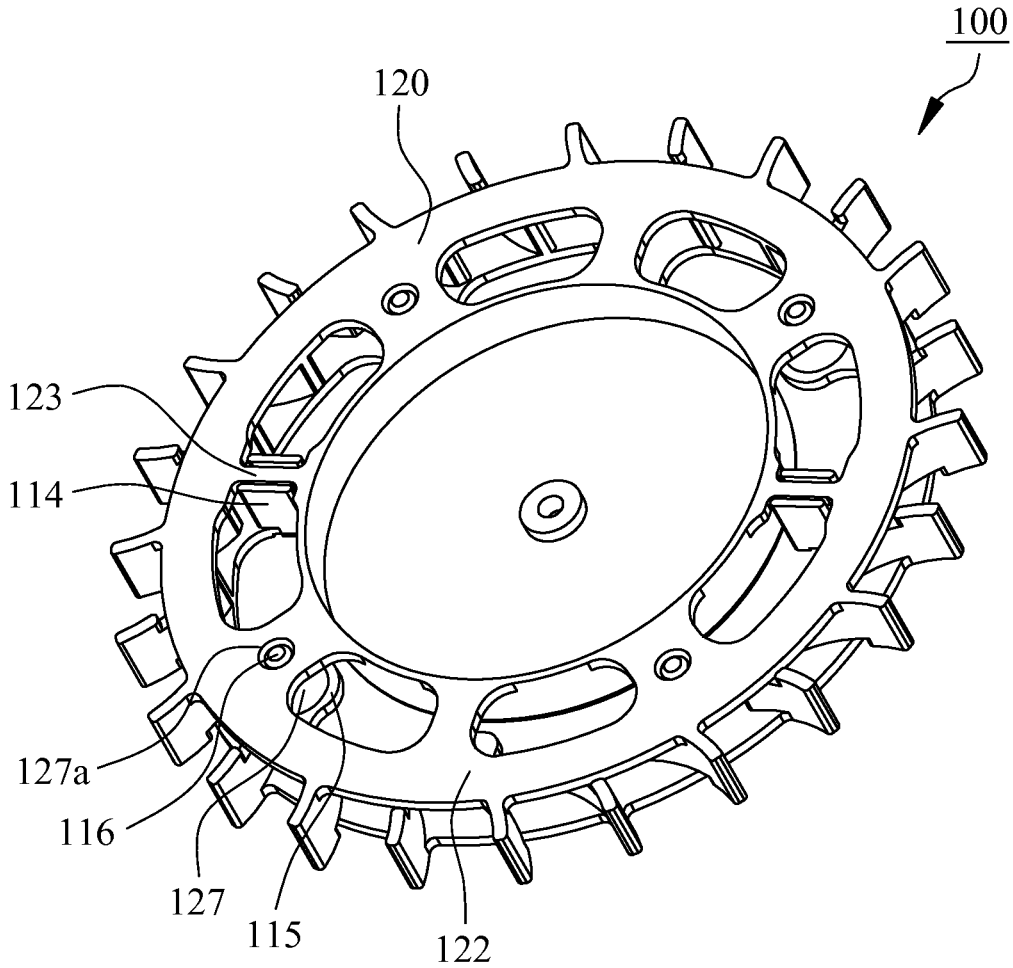
FIG. 6 is another perspective view illustrating the fan structure in accordance with an embodiment of the present invention.
Figure 7:
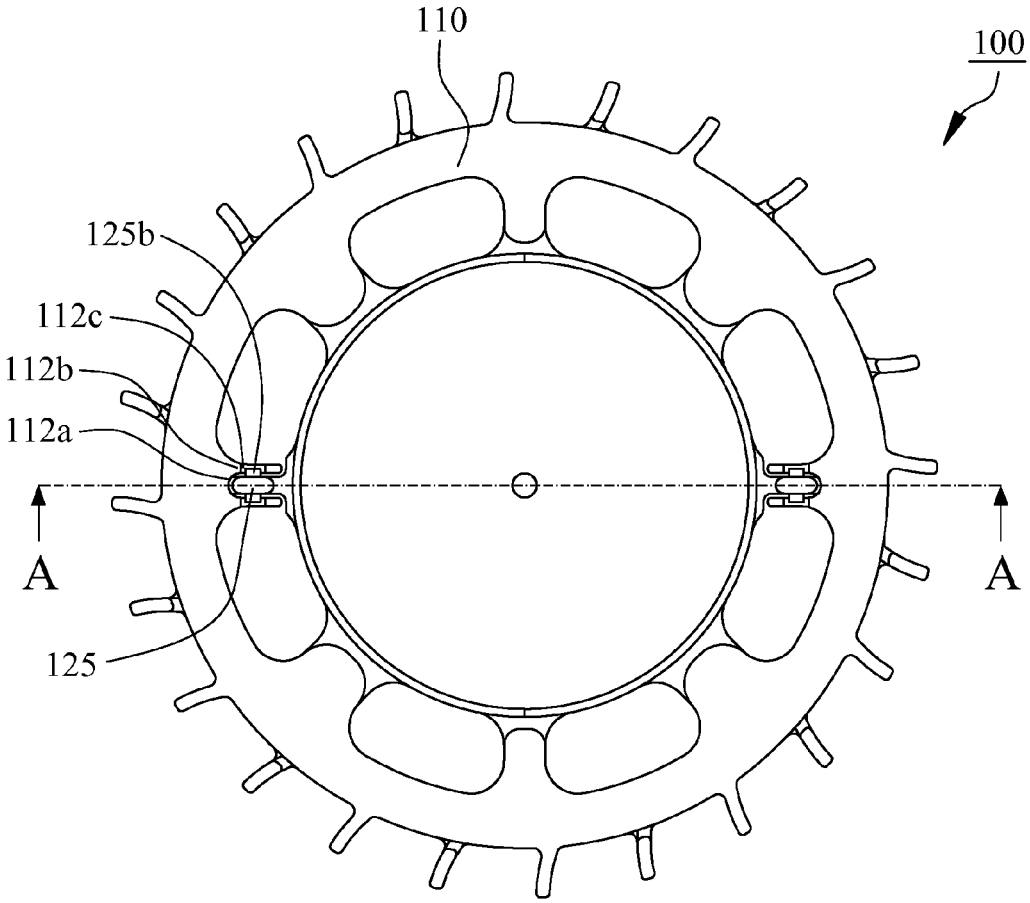
FIG. 7 is a top view illustrating the fan structure in accordance with an embodiment of the present invention.
Figure 8:
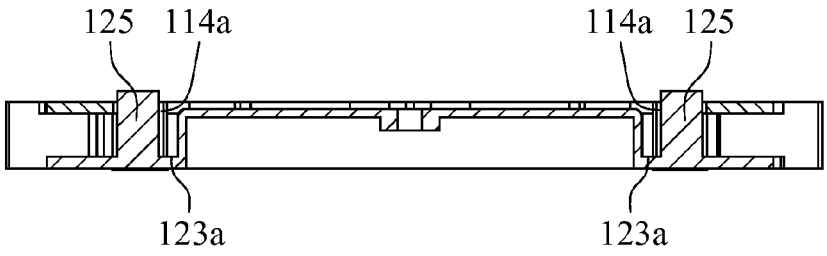
FIG. 8 is a sectional view along A-A direction of FIG. 7 illustrating the fan structure in accordance with an embodiment of the present invention.

Referring to FIGS. 2, 5 and 6, in this invention the first impeller 110 is fixed with the second impeller 120, wherein the first bottom surface 111*c* of the first annular substrate 111 is faced toward the second top surface 122*c* of the second annular substrate 122, each of the first blades 113 is located in the second accommodating space S2 separately, and each of the second blades 124 is located in the first accommodating space S1 separately. Besides, each of the first blades 113 and each of the second blades 124 are arranged in a staggered relationship and the hub 121 of the second impeller 120 is surrounded with the first blades 113 and the second blades 124. The engaging member 125 of the second impeller 120 is inserted into the engaging hole 112*a* of the first impeller 110.

Referring to FIGS. 2, 3, 5 and 6, in this embodiment, the first impeller 110 further comprises at least one pair of guiding plates 114 formed on the first ribs 112, both of the guiding plates 114 have a guiding slot 114*a* in communication with the engaging hole 112*a*, and the engaging member 125 is disposed in the guiding slot 114*a*.

Referring to FIGS. 2, 6, 7 and 8, each of the first ribs 112 comprises a surface 112*b* and an engaging slot 112*c* recessed to the surface 112*b*, wherein the engaging slot 112*c* is in communication with the engaging hole 112*a*, the engaging member 125 has an annular surface 125*a* and at least one engaging portion 125*b* protruded to the annular surface 125*a*, and the engaging portion 125*b* is inserted into the engaging slot 112*c*. With reference to FIG. 6, preferably, each of the second ribs 123 is clamped between each pair of the guiding plates 114 so as to increase mechanical strength of the first impeller 110 and the second impeller 120. The first impeller 110 and the second impeller 120 are fabricated separately that makes the first blades 113 of the first impeller 110 and the second blades 124 of the second impeller 120 easy to be made. Via the engaging member 125 being inserted into the engaging hole 112*a*, the first impeller 110 is fixed with the second impeller 120 and enables each of the first blades 113 to be located in the second accommodating space S2 separately and each of the second blades 124 to be located in the first accommodating space S1 separately so that the number of fan blades may be increased. Besides, owning to the forming molds of the first impeller 110 and the second impeller 120 are separately fabricated thereby lowering processing difficulty, raising mechanical strength and extending mold life for the forming molds.

Referring again to FIGS. 2, 3 and 4, in this embodiment, the first impeller 110 further comprises a plurality of third ribs 115 and at least one insertion pillar 116 formed on the third ribs 115, the second impeller 120 further comprises a plurality of fourth ribs 126 and at least one insertion base 127 formed on the fourth ribs 126, and the insertion pillar 116 is inserted into the insertion base 127. In this embodiment, the insertion base 127 has an insertion slot 127*a* penetrated through the fourth ribs 126, and the insertion pillar 116 is inserted into the insertion slot 127*a* of the insertion base 127 to increase the engagement strength between the first impeller 110 and the second impeller 120. Preferably, with reference to FIG. 4, each of the second ribs 123 has a first width L1, each of the fourth ribs has a second width L2, and the second width L2 is greater than the first width L1 to enable a plurality of vents H of the fan structure 100 to possess higher ventilation rates thereby increasing heat-dissipation efficiency.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A fan structure comprising:

a first impeller having a first annular substrate, a plurality of first ribs, and a plurality of first blades, wherein the first ribs and the first blades are formed on the first annular substrate, each of the first ribs comprises an engaging hole, and a first accommodating space is formed between each of the adjacent first blades, wherein the first annular substrate comprises a first outer lateral surface, a first inner lateral surface corresponded to the first outer lateral surface, a first bottom surface and a first top surface corresponded to the first bottom surface, wherein the first bottom surface is in communication with the first outer lateral surface and the first inner lateral surface, the first ribs are formed on the first inner lateral surface, and the first blades are formed on the first bottom surface; and a second impeller having a hub, a second annular substrate, a plurality of second ribs, a plurality of second blades and at least one engaging member formed on the second ribs, wherein the second annular substrate comprises a second outer lateral surface, a second inner lateral surface corresponded to the second outer lateral surface, a second top surface and a second bottom surface corresponded to the second top surface, wherein the second top surface is in communication with the second outer lateral surface and the second inner lateral surface, the second ribs are formed on the second inner lateral surface, the second blades are formed on the second top surface, and the first bottom surface of the first annular substrate is faced toward the second top surface of the second annular substrate, wherein the second ribs are located between the second annular substrate and the hub, the second blades are formed on the second annular substrate, a second accommodating space is formed between each of the adjacent second blades, each of the first blades is located in the second accommodating space separately, each of the second blades is located in the first accommodating space separately, and the engaging member is inserted into the engaging hole.

2. The fan structure in accordance with claim 1, wherein each of the first blades comprises a first inner blade protruded to the first bottom surface of the first annular substrate and a first outer blade protruded to the first outer lateral surface of the first annular substrate.

3. The fan structure in accordance with claim 1, wherein each of the second blades comprises a second inner blade protruded to the second top surface of the second annular substrate and a second outer blade protruded to the second outer lateral surface of the second annular substrate.

4. The fan structure in accordance with claim 1, wherein the first impeller further comprises at least one pair of guiding plates formed on the first ribs, both of the guiding plates have a guiding slot in communication with the engaging hole, and the engaging member is disposed in the guiding slot.

5. The fan structure in accordance with claim 1, wherein each of the first ribs comprises a surface and an engaging slot recessed to the surface, the engaging slot is in communication with the engaging hole, the engaging member has an annular surface and at least one engaging portion protruded to the annular surface, and the engaging portion is inserted into the engaging slot.

6. The fan structure in accordance with claim 1, wherein the first impeller further comprises a plurality of third ribs and at least one insertion pillar formed on the third ribs, the second impeller further comprises a plurality of fourth ribs and at least one insertion base formed on the fourth ribs, and the insertion pillar is inserted into the insertion base.

7. The fan structure in accordance with claim 6, wherein the insertion base has an insertion slot and the insertion pillar is inserted into the insertion slot of the insertion base.

8. The fan structure in accordance with claim 1, wherein one end of each of the second ribs is in communication with the second annular substrate and another end of each of the second ribs is in communication with the hub.

9. A fan structure comprising:

a first impeller having a first annular substrate, a plurality of first ribs, and a plurality of first blades, wherein the first ribs and the first blades are formed on the first annular substrate, each of the first ribs comprises an engaging hole, and a first accommodating space is formed between each of the adjacent first blades, wherein the first impeller further comprises at least one pair of guiding plates formed on the first ribs, both of the guiding plates have a guiding slot in communication with the engaging hole, and an engaging member is disposed in the guiding slot; and a second impeller having a hub, a second annular substrate, a plurality of second ribs, a plurality of second blades and at least one engaging member formed on the second ribs, wherein the second ribs are located between the second annular substrate and the hub, the second blades are formed on the second annular substrate, a second accommodating space is formed between each of the adjacent second blades, each of the first blades is located in the second accommodating space separately, each of the second blades is located in the first accommodating space separately, and the engaging member is inserted into the engaging hole.

* * * * *